US006954905B2

(12) United States Patent
Brown et al.

(10) Patent No.: US 6,954,905 B2
(45) Date of Patent: Oct. 11, 2005

(54) DISPLAYING TRANSPARENCY CHARACTERISTIC AIDS

(75) Inventors: Michael Wayne Brown, Georgetown, TX (US); Andrew Douglas Hately, Austin, TX (US); Kelvin Roderick Lawrence, Round Rock, TX (US); Michael A. Paolini, Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 489 days.

(21) Appl. No.: 10/059,086

(22) Filed: Jan. 28, 2002

(65) Prior Publication Data

US 2003/0142148 A1 Jul. 31, 2003

(51) Int. Cl.[7] ..... G09G 5/00
(52) U.S. Cl. ..... 715/768; 715/789; 715/790
(58) Field of Search ..... 345/768, 790, 345/766, 789; 715/768, 789, 790, 781, 767

(56) References Cited

U.S. PATENT DOCUMENTS

| | | | | |
|---|---|---|---|---|
| 5,179,655 A | | 1/1993 | Noguchi et al. | |
| 5,303,388 A | | 4/1994 | Kreitman et al. | |
| 5,313,230 A | | 5/1994 | Venolia et al. | |
| 5,333,256 A | | 7/1994 | Green et al. | |
| 5,377,317 A | | 12/1994 | Bates et al. | |
| 5,390,295 A | | 2/1995 | Bates et al. | |
| 5,461,399 A | | 10/1995 | Cragun | |
| 5,463,775 A | | 10/1995 | DeWitt et al. | |
| 5,479,598 A | | 12/1995 | Feitelson et al. | |
| 5,499,334 A | | 3/1996 | Staab | |
| 5,533,182 A | | 7/1996 | Bates et al. | |
| 5,550,969 A | | 8/1996 | Torres et al. | |
| 5,555,354 A | | 9/1996 | Strasnick et al. | |
| 5,572,672 A | | 11/1996 | Dewitt et al. | |
| 5,590,264 A | | 12/1996 | Keane et al. | |
| 5,590,265 A | | 12/1996 | Nakazawa | |
| 5,600,779 A | | 2/1997 | Palmer et al. | |
| 5,640,498 A | | 6/1997 | Chew | |
| 5,651,107 A | * | 7/1997 | Frank et al. | 345/768 |
| 5,694,561 A | | 12/1997 | Malamud et al. | |
| 5,701,400 A | * | 12/1997 | Amado | 706/45 |

(Continued)

FOREIGN PATENT DOCUMENTS

| | | | |
|---|---|---|---|
| JP | 5134830 A | 12/1992 | G06F/11/32 |
| WO | WO 00/14574 | 3/2000 | G01V/1/28 |

OTHER PUBLICATIONS

Make the Language Bar Transparent, 1 page, wysiwyg:// fraContent.fraRightFrame.50/ht... olbar_change_transparency.asp?frame=true.

TUCOWS Shell Enhancements Trans–XP, 2 pages, wysiwyg://20/http://www.tucows.com/system/preview/232-626.html.

The Iconfactory: Your Quality Freeware Icons Hub (ibxp_ home.asp), 2 pages, http://www.iconfactory.com/ibxp_ home.asp.

(Continued)

*Primary Examiner*—Raymond J. Bayerl
*Assistant Examiner*—Ting Zhou
(74) *Attorney, Agent, or Firm*—Marilyn Smith Dawkins; Amy J. Pattillo

(57) ABSTRACT

A method, system and program for displaying transparency characteristic aids are provided. A user interface is displayed comprising at least one displayable object within a display area controlled by a computer system. Responsive to an initiating event, placing a transparency characteristic aid within the display area in association with the initiating event, such that the at least one displayable object is not obscured by the transparency characteristic aid. The transparency resource aid may indicate resource usage of hardware, software, and graphical characteristics.

15 Claims, 4 Drawing Sheets

U.S. PATENT DOCUMENTS 5,764,229 A 6/1998 Bennett
5,805,163 A 9/1998 Bagnas
5,805,166 A 9/1998 Hall et al.
5,812,688 A * 9/1998 Gibson ..... 381/119
5,825,355 A 10/1998 Palmer et al.
5,852,440 A 12/1998 Grossman et al.
5,859,639 A 1/1999 Ebrahim
5,889,530 A 3/1999 Findlay
5,892,511 A 4/1999 Gelsinger et al.
5,898,433 A 4/1999 Hijikata
5,917,492 A 6/1999 Bereiter et al.
5,923,326 A 7/1999 Bittinger et al.
5,936,612 A 8/1999 Wang
5,977,972 A 11/1999 Bates et al.
5,982,369 A 11/1999 Sciammarella et al.
5,999,178 A 12/1999 Hwang et al.
6,002,397 A 12/1999 Jaaskelainen, Jr.
6,002,400 A 12/1999 Loring et al.
6,005,570 A 12/1999 Gayraud et al.
6,025,841 A 2/2000 Finkelstein et al.
6,040,831 A 3/2000 Nishida
6,049,798 A 4/2000 Bishop et al.
6,064,974 A 5/2000 Broekhuijsen
6,081,266 A 6/2000 Sciammarella
6,097,371 A 8/2000 Siddiqui et al.
6,111,614 A 8/2000 Mugura et al.
6,201,539 B1 * 3/2001 Miller et al. ..... 345/866
6,295,062 B1 9/2001 Tada et al.
6,297,818 B1 10/2001 Ulrich et al.
6,342,908 B1 1/2002 Bates et al.
6,344,863 B1 2/2002 Capelli et al.
6,392,640 B1 5/2002 Will
6,396,482 B1 5/2002 Griffin et al.
6,429,883 B1 8/2002 Plow et al.
6,462,757 B1 10/2002 Kao et al.
6,473,102 B1 10/2002 Rodden et al.
6,476,796 B1 11/2002 Kuzunuki et al.
6,489,950 B1 12/2002 Griffin et al.
6,493,002 B1 12/2002 Christensen
6,512,529 B1 * 1/2003 Janssen et al. ..... 345/790
6,523,079 B2 2/2003 Kikinis et al.
6,532,005 B1 3/2003 Campbell
6,542,165 B1 4/2003 Ohkado
6,549,218 B1 * 4/2003 Gershony et al. ..... 345/781
6,567,812 B1 5/2003 Garrecht et al.
6,573,915 B1 6/2003 Sivan et al.
6,587,128 B2 7/2003 Kanevsky et al.
6,618,170 B1 9/2003 Whiting et al.
6,630,943 B1 10/2003 Nason et al.
6,633,310 B1 * 10/2003 Andrew et al. ..... 345/728
6,670,970 B1 * 12/2003 Bonura et al. ..... 345/768
6,720,982 B1 4/2004 Sakaguchi
6,741,266 B1 * 5/2004 Kamiwada et al. ..... 345/768
2001/0030667 A1 10/2001 Kelts
2001/0055017 A1 12/2001 Ording
2002/0052685 A1 5/2002 Kamiya et al.
2002/0054117 A1 5/2002 Van Dantzich et al.
2002/0078456 A1 * 6/2002 Hudson et al. ..... 725/60
2002/0138602 A1 * 9/2002 Vinberg ..... 709/223
2002/0140725 A1 10/2002 Horii
2003/0142108 A1 7/2003 Brown et al.
2003/0142109 A1 7/2003 Brown et al.
2003/0142132 A1 7/2003 Brown et al.
2003/0142133 A1 7/2003 Brown et al.
2003/0142137 A1 7/2003 Brown et al.
2003/0142138 A1 7/2003 Brown et al.
2003/0142139 A1 7/2003 Brown et al.
2003/0142140 A1 7/2003 Brown et al.
2003/0142141 A1 7/2003 Brown et al.
2003/0142143 A1 7/2003 Brown et al.
2003/0142149 A1 7/2003 Brown et al.

OTHER PUBLICATIONS

Tweak_XP, 2 pages, http://www.totalidea.ce/transxp.htm.
Trans–XP Information, Details, and Download from VoodooFiles.com, 1 page, wysiwyg://15/http://www.voodoofiles.com/5817.
Cronosoft, 1 page, wysiwyg://26/http://www.cronosoft.com/download/ghwxp/index.htm.
IBM Technical Disclosure Bulletin, "Balloon Windows for Supplementary Dialogues and Information", vol. 33, No. 10A, Mar. 1991, pp. 263–265.
IBM Technical Disclosure Bulletin, "Translucent Windows: Dragging an Image without Obscuring the Desktop:", vol. 37, No. 10, Oct. 1994, p. 15.
IBM Research Disclosure 431180, "Progressively animated graphical overlays", Mar. 2000, p. 592.
Displaying Specified Resource Usage.
Displaying Transparent Resource Aids.
Selectively Adjusting Transparency of Windows Within a User Interface.
Changing the Alpha Levels of an Application Window to Indicate a Status of a Computing Task.
Adjusting the Tint of a Translucent Window to Convey Status.
Adjusting Transparency of Windows to Reflect Recent Use.
Specifying Audio Output According to Window Graphical Characteristics.
Automatic Window Representation Adjustment.
Varying Heights of Application Images to Convey Application Status.
Selectively Adjusting the Translucency of Windows in Response to a Scroll Wheel Rotation.
Selectively Adjusting the Order of Windows in Response to a Scroll Wheel Rotation.

* cited by examiner

DISPLAYING TRANSPARENCY CHARACTERISTIC AIDS

CROSS-REFERENCE TO RELATED APPLICATIONS

The present application is related to the following co-pending applications, which are filed on even date herewith and incorporated herein by reference:

(1) U.S. patent application Ser. No. 10/059,093, filed Jan. 28, 2002; and (2) U.S. patent application Ser. No. 10/059,011, filed Jan. 28, 2002;

(3) U.S. patent application Ser. No. 10/059,092, filed Jan. 28, 2002;

(4) U.S. patent application Ser. No. 10/059,088, filed Jan. 28, 2002;

(5) U.S. patent application Ser. No. 10/059,027, filed Jan. 28, 2002;

(6) U.S. patent application Ser. No. 10/058,532, abandoned on Mar. 4, 2005;

(7) U.S. patent application Ser. No. 10/058,397, abandoned on Mar. 4, 2005;

(8) U.S. patent application Ser. No. 10/058,772, filed Jan. 28, 2002;

(9) U.S. patent application Ser. No. 10/058,300, abandoned on Mar. 4, 2005;

(10) U.S. patent application Ser. No. 10/058,493, abandoned on Mar. 4, 2005; and

(11) U.S. patent application Ser. No. 10/058,599, abandoned on Mar. 4, 2005;

BACKGROUND OF THE INVENTION

1. Technical Field

The present invention relates in general to computer systems and, in particular, to graphical user interfaces. Still more particularly, the present invention relates to displaying current transparency characteristics of windows in response to an initiating event.

2. Description of the Related Art

Most operating systems provide a graphical user interface (GUI) for controlling a visual computer environment. The GUI represents programs, files, and options with graphical images, such as icons, menus, and dialog boxes on the screen. Graphical items defined within the GUI work the same way for the user in most software because the GUI provides standard software routines to handle these elements and report the user's actions.

A typical graphical element defined by a GUI is a window or other defined area of a display containing distinguishable text, graphics, video, audio and other information for output. A display area may contain multiple windows associated with a single software program or multiple software programs executing concurrently.

Often, when multiple graphical objects are displayed concurrently, the graphical objects will overlap. The order in which graphical objects are drawn on top of one another onscreen to simulate depth is typically known as the z-order. Typically, those objects at the top of the z-axis obscure the view of those graphical objects drawn below.

In some operating systems, a level of transparency or translucency may be applied to graphical objects, and in particular to windows. By applying a level of translucency to upper level windows, lower level windows are visible therethrough. Utilizing translucency is particularly advantageous such that the title bars for multiple levels of windows are visible where the windows overlap.

According to U.S. patent application Ser. No. 10/058,532 (Attorney Docket No. AUS920010518US1), the levels of transparency of windows may be adjusted in order to depict resource utilization in association with each window or to depict a current status of the application executing in association with the window. With multiple criteria determining the transparency of windows within a graphical display, it easily becomes confusing to a user what the transparency of each window means; and where the transparency of windows corresponds with a resource usage value, the user may not be able to visibly discern the transparency level with accuracy.

In view of the foregoing, it would be advantageous to provide a method, system, and program for dynamically displaying transparency characteristics for windows within a display area. In particular, it would be advantageous to provide a method, system, and program for dynamically displaying the transparency characteristics of windows, such that the transparency characteristic aids do not obscure the view of other graphics displayed.

SUMMARY OF THE INVENTION

In view of the foregoing, it is therefore an object of the present invention to provide an improved computer system.

It is another object of the present invention to provide an improved graphical user interface.

It is yet another object of the present invention to provide a method, system and program for displaying current transparency characteristics of windows in response to an initiating event.

According to one aspect of the present invention, a user interface is displayed comprising at least one displayable object within a display area controlled by a computer system. A transparency associated with the at least one displayable object is monitored. Responsive to an initiating event, a transparency characteristic aid comprising said monitored transparency is placed within the display area, such that the at least one displayable object is not obscured by the transparency characteristic aid. An initiating event may include a cursor placement, an occurrence of a user-defined event, and a user input. The transparency characteristic aid is preferably transparent and positioned to maximize space remaining in the display area.

All objects, features, and advantages of the present invention will become apparent in the following detailed written description.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE PREFERRED EMBODIMENT

Figure 1:
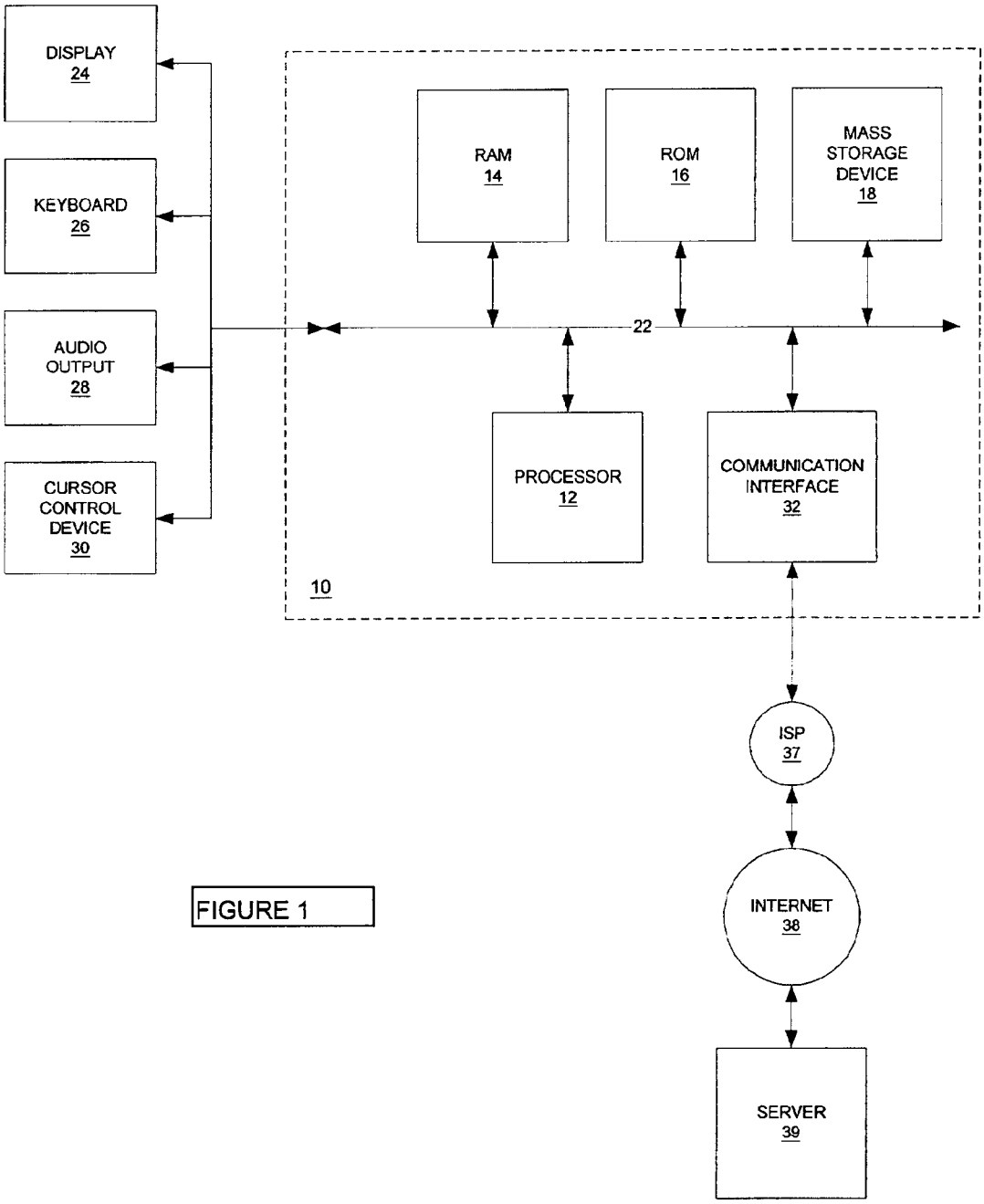
FIG. 1 depicts one embodiment of a computer system with which the method, system and program of the present invention may advantageously be utilized.

A method, system, and program for transparently displaying transparency characteristics of windows in response to an initiating event are provided. A transparent display of transparency characteristics may include text, graphics, video, and other displayable objects displayed such that currently placed displayed objects are not obscured. Further, audible outputs may enhance transparency characteristics output.

A "displayable object" may include text, icons, video, graphics, windows, or other logical graphical representations displayable within a display area. Displayable objects may be hidden or visible. Further, displayable objects may be layered in a z-order. Moreover, a displayable object may utilize a portion of a display area or may extend across the entirety of a display area. A displayable object may or may not include definable boundaries.

For purposes of the present invention, transparency characteristics may include, but are not limited to, transparency percentages, alpha levels, criteria utilized to set transparency, z-order, and other characteristics that may be associated with the transparency of a window or other displayable object.

Transparency characteristics may be dynamically provided in response to an initiating event. For purposes of the present invention, an initiating event may include, but is not limited to, a user directing a cursor over a transparency sensitive region or a user defined event occurring. Preferably, each icon, graphic, window and other displayable object has a transparency sensitive region where if a cursor passes over the region, transparency characteristics of the displayable object are transparently displayed. In addition, a displayable object may have a transparency sensitive region wherein a user is required to input a key entry, voice entry or other input to initiate the transparent display. A user defined event may include a particular input from the user or a transparency threshold that has reached a maximum or minimum defined by the user.

To depict transparency characteristics, multiple output formats may be utilized, where advantageously each output format utilizes transparency such that other displayed objects are not completely obscured. Output formats may include, but are not limited to, textual output, graphical output, video output, and audible output.

Transparency is a graphical feature that is particularly advantageous to the present invention when displaying transparency information as a transparency characteristics aid that preferably overlaps other graphical elements to conserve screen space. As will be understood by one skilled in the art, by making a resource aid appear transparent on a computer screen, other elements below the transparency characteristics aid are visible through the resource aid. Further, the transparency of a transparency characteristics aid may be adjusted from opaque to totally transparent.

Typically, the transparency attribute is stored with color values in an alpha channel. Then, when calculating the appearance of a given pixel, the graphic processor uses the alpha channel values to determine the pixel's color through a process termed alpha blending. Through alpha blending, the process adds a fraction of the color of the transparent object set by the alpha channel value to the color of the displayable object below.

Mixing the colors together gives the appearance that the displayable object below is seen through a layer of the transparency characteristic aid. In addition to alpha blending, additional shading may be added to create shadows and other graphical images to cue the viewer to the position of the transparency characteristics aid.

In the following description, for the purposes of explanation, numerous specific details are set forth to provide a thorough understanding of the present invention. It will be apparent, however, to one skilled in the art that the present invention may be practiced without these specific details. In other instances, well-known structures and devices are shown in block diagram form to avoid unnecessarily obscuring the present invention.

Hardware Overview

The present invention may be executed in a variety of systems, including a variety of computing systems and electronic devices under a number of different operating systems. In one embodiment of the present invention, the computing system is a portable computing system such as a notebook computer, a palmtop computer, a personal digital assistant, a telephone or other electronic computing system that may also incorporate communications features that provide for telephony, enhanced telephony, messaging and information services. However, the computing system may also be, for example, a desktop computer, a network computer, a midrange computer, a server system or a mainframe computer. Therefore, in general, the present invention is preferably executed in a computer system that performs computing tasks such as manipulating data in storage that is accessible to the computer system. In addition, the computer system preferably includes at least one output device and at least one input device.

Referring now to the drawings and in particular to FIG. 1, there is depicted one embodiment of a computer system with which the method, system and program of the present invention may advantageously be utilized. Computer system 10 comprises a bus 22 or other communication device for communicating information within computer system 10, and at least one processing device such as processor 12, coupled to bus 22 for processing information. Bus 22 preferably includes low-latency and high-latency paths that are connected by bridges and controlled within computer system 10 by multiple bus controllers.

Processor 12 may be a general-purpose processor such as IBM's PowerPC™ processor that, during normal operation, processes data under the control of operating system and application software stored in a dynamic storage device such as random access memory (RAM) 14 and a static storage device such as Read Only Memory (ROM) 16. The operating system preferably provides a graphical user interface (GUI) to the user. In a preferred embodiment, application software contains machine executable instructions that when executed on processor 12 carry out the operations depicted in the flowchart of FIG. 4 and others described herein. Alternatively, the steps of the present invention might be performed by specific hardware components that contain hardwire logic for performing the steps, or by any combination of programmed computer components and custom hardware components.

The present invention may be provided as a computer program product, included on a machine-readable medium having stored thereon the machine executable instructions used to program computer system 10 to perform a process according to the present invention. The term "machine-readable medium" as used herein includes any medium that participates in providing instructions to processor 12 or other components of computer system 10 for execution. Such a medium may take many forms including, but not limited to, non-volatile media, volatile media, and transmission media. Common forms of non-volatile media include, for example, a floppy disk, a flexible disk, a hard disk, magnetic tape or any other magnetic medium, a compact disc ROM (CD-ROM), a digital video disc-ROM (DVD-ROM) or any other optical medium, punch cards or any other physical medium with patterns of holes, a programmable ROM (PROM), an erasable PROM (EPROM), electrically EPROM (EEPROM), a flash memory, any other memory chip or cartridge, or any other medium from which computer system 10 can read and which is suitable for storing instructions. In the present embodiment, an example of non-volatile media is storage device 18. Volatile media includes dynamic memory such as RAM 14. Transmission media includes coaxial cables, copper wire or fiber optics, including the wires that comprise bus 22. Transmission media can also take the form of acoustic or light waves, such as those generated during radio wave or infrared data communications.

Moreover, the present invention may be downloaded as a computer program product, wherein the program instructions may be transferred from a remote computer such as a server 39 to requesting computer system 10 by way of data signals embodied in a carrier wave or other propagation medium via a network link 34 (e.g., a modem or network connection) to a communications interface 32 coupled to bus 22. Communications interface 32 provides a two-way data communications coupling to network link 34 that may be connected, for example, to a local area network (LAN), wide area network (WAN), or as depicted herein, directly to an Internet Service Provider (ISP) 37. In particular, network link 34 may provide wired and/or wireless network communications to one or more networks.

ISP 37 in turn provides data communication services through the Internet 38 or other network. Internet 38 may refer to the worldwide collection of networks and gateways that use a particular protocol, such as Transmission Control Protocol (TCP) and Internet Protocol (IP), to communicate with one another. ISP 37 and Internet 38 both use electrical, electromagnetic, or optical signals that carry digital or analog data streams. The signals through the various networks and the signals on network link 34 and through communication interface 32, which carry the digital or analog data to and from computer system 10, are exemplary forms of carrier waves transporting the information.

Further, multiple peripheral components may be added to computer system 10. For example, an audio output 28 is attached to bus 22 for controlling audio output through a speaker or other audio projection device. A display 24 is also attached to bus 22 for providing visual, tactile or other graphical representation formats. A keyboard 26 and cursor control device 30, such as a mouse, trackball, or cursor direction keys, are coupled to bus 22 as interfaces for user inputs to computer system 10. Keyboard 26 and cursor control device 30 can control the position of a cursor 43 positioned within a display area 32 of display 24. Display 24 may include both non-transparent surfaces, such as monitors, and transparent surfaces, such as headset glasses or vehicle windshield displays.

It should be understood that keyboard 26 and cursor control device 30 are examples of multiple types of input devices that may be utilized in the present invention. In alternate embodiments of the present invention, additional input and output peripheral components may be added.

Transparent Characteristics Context

Figure 2:
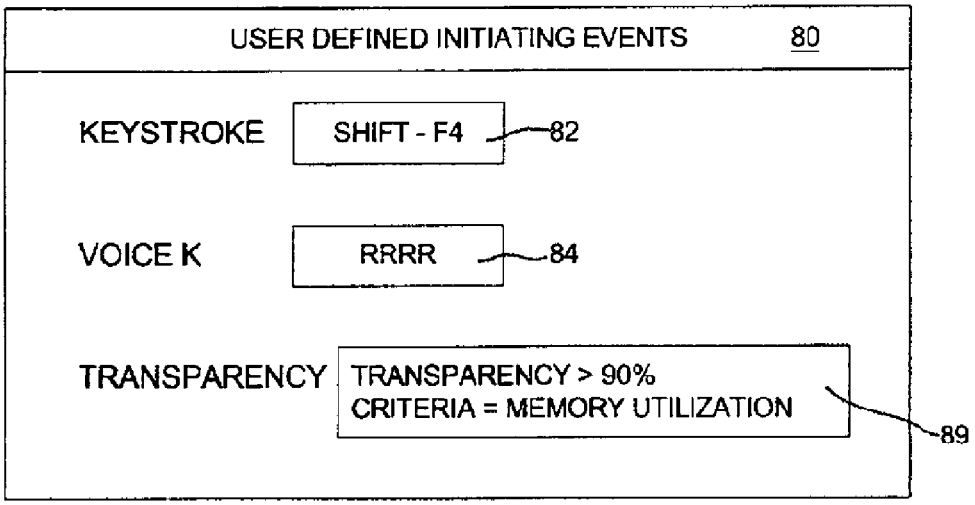
FIG. 2 illustrates a graphical representation of a window in which a user has defined initiating events in accordance with the method, system, and program of the present invention.

With reference now to FIG. 2, there is illustrated a graphical representation of a window in which a user has defined initiating events in accordance with the method, system, and program of the present invention. As depicted, a window 80 within a display area contains a keystroke selection 82, a voice command (K) selection 84, and transparency selections 89.

Keystroke selection 82 is advantageously a keystroke that when entered, initiates display of transparency characteristics associated with the object that a cursor is placed over when the keystroke is detected. By defining keystroke selection 82, a user may control transparency characteristics for windows, icons and other displayable objects that do not include a sensitive region. Alternatively, by indicating keystroke selection 82, a user may specify that display of transparency characteristics requires a keystroke in addition to the position of the cursor.

Voice command (K) selection 84 is advantageously a voice command, that when entered, initiates display of transparency characteristics associated with the object a cursor is placed over when the voice command is detected. In particular, voice commands may also be utilized to place the cursor in a particular position.

Transparency selections 89 advantageously specify transparency characteristics settings for windows and other displayable objects. In the present example, when the transparency of a window rises above 90% transparency, then a display of transparency characteristics of that window is initiated. In addition, when memory utilization is utilized as the criteria for adjusting window transparency, then display of a transparency characteristics for depicting the criteria utilized to determine transparency is initiated.

Figure 3:
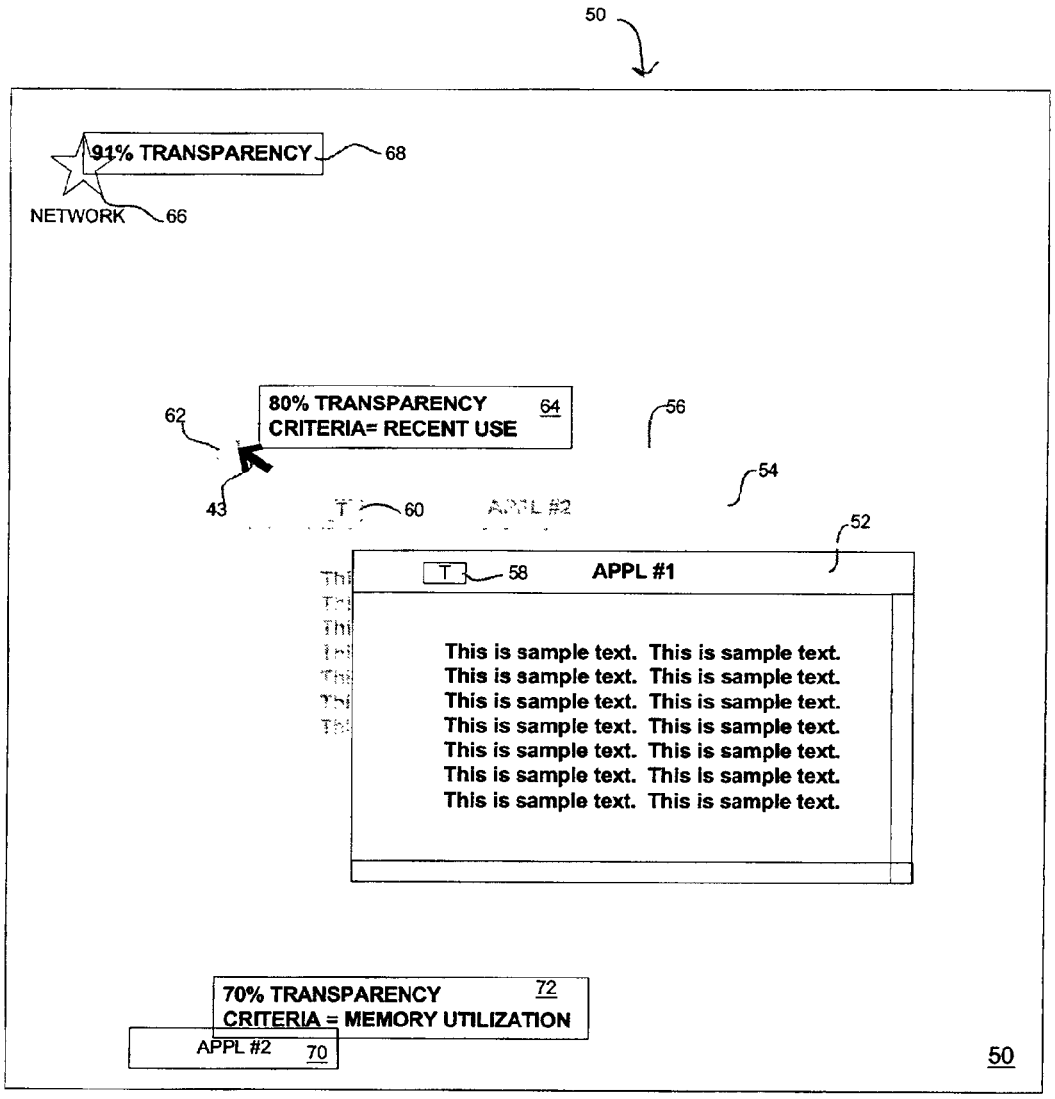
FIG. 3 depicts a graphical representation of a display area in which transparency characteristics information is displayed in accordance with the method, system, and program of the present invention.

Referring now to FIG. 3, there is depicted a graphical representation of a display area in which transparency characteristics information is displayed in accordance with the method, system, and program of the present invention. As illustrated, a display area 50 within a display contains a network icon 66. A transparency characteristic aid 68 is displayed in association with network icon 66. Preferably, transparency characteristic aid 68 is transparent such that the view of network icon 66 and other displayable objects are not completely obscured by transparency characteristic aid 68.

In the present example, transparency characteristic aid 44 is preferably initiated in response to adjusting network icon 66 to greater than 90% transparency. In particular, network icon 66 may adjust in transparency in response to adjustments in network usage, other criteria, or a user specified transparency setting.

In addition, display area 50 contains windows 52, 54, and 56, each containing sample text. Transparency sensitive regions 58, 60, and 62 are illustrated within the title bar of window 50. In the example, cursor 43 is placed over sensitive region 62. In response to the position of cursor 43, transparency characteristic aid 64 is displayed. In particular, sensitive region 62 is only a limited graphical portion of window 56 such that transparency characteristic aid 64 will only be displayed when cursor 43 is positioned over that portion of window 56.

In addition, in the example, transparency characteristic aid 68 is depicted in response to memory utilization being a criteria for setting transparency. Advantageously, transparency characteristic aid is illustrated in association with a minimized window icon 70, regardless of whether minimized window icon 70 reflects the current transparency assigned to the application.

Figure 4:
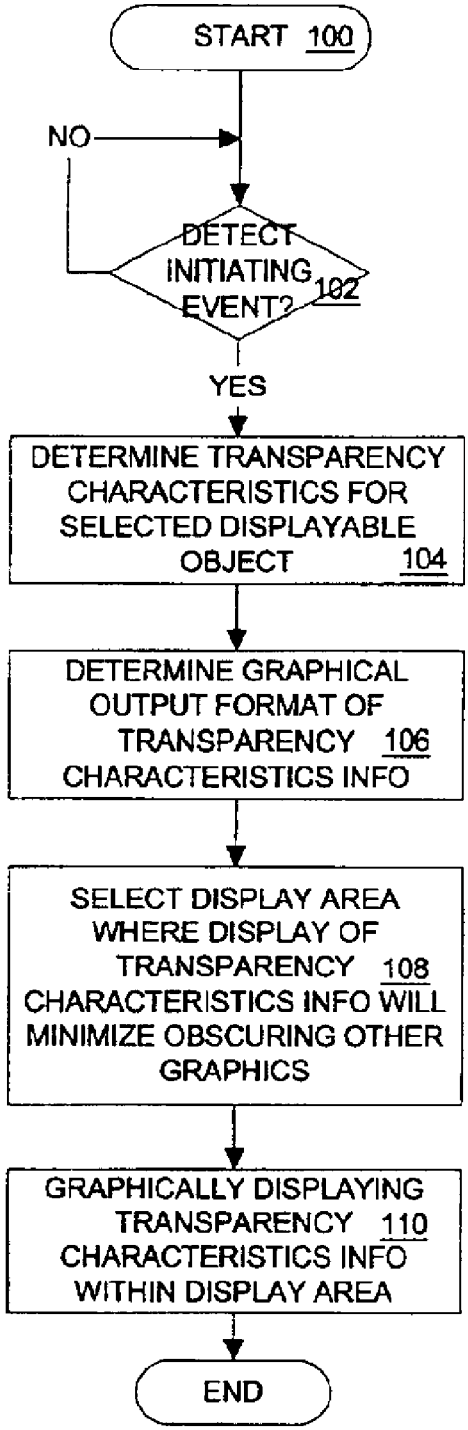
FIG. 4 illustrates a high level logic flowchart of a process and program for initiating the display of transparency characteristic aids in accordance with the method, system, and program of the present invention.

With reference now to FIG. 4, there is illustrated a high level logic flowchart of a process and program for initiating the display of transparency characteristic aids in accordance with the method, system, and program of the present invention. As depicted, the process starts at block 100 and thereafter proceeds to block 102.

Block 102 illustrates a determination as to whether an initiating event has been detected. If an initiating event has not been detected, then the process iterates at block 102. If an initiating event has been detected, then the process passes to block 104.

Block 104 depicts determining the transparency characteristics for the selected displayable object. Next, block 106 illustrates determining the graphical output format of the transparency characteristics information. In particular, the graphical output format may include multiple shapes and sizes of graphical output blocks. Thereafter, block 108 depicts selecting the display area in association with the displayable object where display of the transparency characteristics information will minimize obscuring the visibility of other displayable objects. Further, block 110 illustrates graphically displaying the transparency characteristics aid within the display area, and the process ends.

While the invention has been particularly shown and described with reference to a preferred embodiment, it will be understood by those skilled in the art that various changes in form and detail may be made therein without departing from the spirit and scope of the invention.

What is claimed is:

1. A method for displaying characteristic aids in a display area, said method comprising the steps of:

displaying a user interface comprising at least one displayable object within a display area controlled by a computer system;

monitoring a transparency associated with said at least one displayable object;

responsive to an initiating event, placing a graphical transparency characteristic aid displaying a percentage indicating said monitored transparency of said at least one displayable object within said display area, such that said at least one displayable object is not obscured by said graphical transparency characteristic aid;

wherein placing said graphical transparency characteristic aid further comprises:

determining a graphical output format for said graphical transparency characteristic aid;

adjusting a transparency of said graphical transparency characteristic aid according to user transparency preferences;

determining a display position for said graphical transparency characteristic aid; and adjusting said transparency of said graphical transparency characteristic aid according to said display position.

2. The method for displaying characteristic aids in accordance with claim 1, said method further comprising the step of:

responding to an initiating event, wherein said initiating event is at least one of a cursor placement, an occurrence of a user-defined event, and a user input.

3. The method for displaying characteristic aids in accordance with claim 1, said step of monitoring a transparency further comprising the step of:

monitoring a plurality of factors that determine said transparency associated with said at least one displayable object.

4. The method for displaying characteristic aids in accordance with claim 1, said method further comprising the step of:

placing said graphical transparency characteristic aid to maximize space remaining in said display area.

5. The method for displaying characteristic aids in accordance with claim 1, said method further comprising the step of:

initializing said graphical transparency characteristic aid, wherein said graphical transparency characteristic aid comprises at least one from among text, graphics, video, and audio.

6. A system for displaying characteristic aids in a display area, said system comprising:

a graphical user interface controlled by a computer system;

means for displaying at least one displayable object within said graphical user interface;

means for monitoring a transparency associated with said at least one displayable object;

means responsive to an initiating event, for placing a graphical transparency characteristic aid displaying a percentage indicating said monitored transparency of said at least one displayable object within said graphical user interface;

wherein said means for placing said graphical transparency characteristic aid further comprise:

means for determining a graphical output format for said graphical transparency characteristic aid;

means for adjusting a transparency of said graphical transparency characteristic aid according to user transparency preferences;

means for determining a display position for said graphical transparency characteristic aid; and means for adjusting said transparency of said graphical transparency characteristic aid according to said display position.

7. The system for displaying characteristic aids in accordance with claim 6, said system further comprising:

means for responding to an initiating event, wherein said initiating event is at least one of a cursor placement, an occurrence of a user-defined event, and a user input.

8. The system for displaying characteristic aids in accordance with claim 6, said means for monitoring a transparency further comprising:

means for monitoring a plurality of factors that determine said transparency associated with said at least one displayable object.

9. The system for displaying characteristic aids in accordance with claim 6, said system further comprising:

means for placing said graphical transparency characteristic aid to maximize space remaining in a display area of said graphical user interface.

10. The system for displaying characteristic aids in accordance with claim 6, said system further comprising:

means for initializing said graphical transparency characteristic aid, wherein said transparency characteristic aid comprises at least one from among text, graphics, video, and audio.

11. A program for displaying characteristic aids in a display area, residing on a tangible computer usable medium having computer readable program code means, the program comprising:

means for enabling display of at least one displayable object within a user interface;

means for monitoring a transparency associated with said at least one displayable object; and means for controlling placement of a graphical transparency characteristic aid displaying a percentage indicating said monitored transparency of said at least one displayable object within said user interface;

wherein said means for controlling placement of said graphical transparency characteristic aid further comprise:

means for determining a graphical output format for said graphical transparency characteristic aid;

means for adjusting a transparency of said graphical transparency characteristic aid according to user transparency preferences;

means for determining a display position for said graphical transparency characteristic aid; and means for adjusting said transparency of said graphical transparency characteristic aid according to said display position.

12. The program for displaying characteristic aids in accordance with claim 11, said program further comprising:

means for detecting an initiating event, wherein said initiating event is at least one of a cursor placement, an occurrence of a user-defined event, and a user input; and means for initiating said placement of said graphical transparency characteristic aid following detection of said initiating event.

13. The program for displaying characteristic aids in accordance with claim 11, said program further comprising:

means for monitoring a plurality of factors that determine said transparency associated with said at least one displayable object.

14. The program for displaying characteristic aids in accordance with claim 11, said program further comprising:

means for controlling placement of said graphical transparency characteristic aid to maximize space remaining in a display area within said user interface.

15. The program for displaying characteristic aids in accordance with claim 11, said program further comprising:

means for initializing said graphical transparency characteristic aid, wherein said transparency characteristic aid comprises at least one from among text, graphics, video, and audio.

* * * * *